US008651842B2

(12) United States Patent
Yamamoto et al.

(10) Patent No.: US 8,651,842 B2
(45) Date of Patent: Feb. 18, 2014

(54) SCROLL COMPRESSOR WITH OPENING/CLOSING MECHANISM FOR THE BACK PRESSURE SPACE

(75) Inventors: Masateru Yamamoto, Sakai (JP); Youhei Nishide, Sakai (JP); Yoshitomo Tsuka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 13/878,953

(22) PCT Filed: Nov. 8, 2011

(86) PCT No.: PCT/JP2011/006233

§ 371 (c)(1),
(2), (4) Date: Apr. 11, 2013

(87) PCT Pub. No.: WO2012/063471

PCT Pub. Date: May 18, 2012

(65) Prior Publication Data

US 2013/0189144 A1 Jul. 25, 2013

(30) Foreign Application Priority Data

Nov. 8, 2010 (JP) ..... 2010-249925

(51) Int. Cl.
*F01C 1/063* (2006.01)
*F04C 18/063* (2006.01)

(52) U.S. Cl.
USPC ..... 418/55.5; 418/55.4

(58) Field of Classification Search
USPC ..... 418/55.4, 55.5, 55.1, 55.2, 55.3, 55.6
See application file for complete search history.

(56) References Cited

U.S. PATENT DOCUMENTS

| | | | | |
|---|---|---|---|---|
| 4,596,521 | A * | 6/1986 | Murayama et al. | 418/55.1 |
| 4,645,437 | A * | 2/1987 | Sakashita et al. | 418/55.5 |
| 5,088,906 | A * | 2/1992 | Richardson, Jr. | 418/55.4 |
| 5,660,539 | A | 8/1997 | Matsunaga et al. | |
| 7,419,370 | B2 * | 9/2008 | Masuda | 418/55.5 |
| 2011/0158838 | A1 | 6/2011 | Nishide | |

FOREIGN PATENT DOCUMENTS

| | | | |
|---|---|---|---|
| JP | 58-160583 | A | 9/1983 |
| JP | 8-121366 | A | 5/1996 |
| JP | 5-26180 | A | 2/1998 |
| JP | 2010-43641 | A | 2/2010 |

OTHER PUBLICATIONS

International Search Report issued in PCT/2011/006233, dated Feb. 14, 2012.

* cited by examiner

*Primary Examiner* — Mary A Davis
(74) *Attorney, Agent, or Firm* — Birch, Stewart, Kolasch & Birch, LLP

(57) ABSTRACT

A scroll compressor includes a high-pressure space capable of communicating with a discharge port and a back pressure space capable of communicating with an intermediate port. A fluid passage includes a seal ring that closes the fluid passage when the pressure of the back pressure space is lower than that of the high-pressure space, and opens the fluid passage when the pressure of the back pressure space is higher than that of the high-pressure space.

4 Claims, 15 Drawing Sheets

SCROLL COMPRESSOR WITH OPENING/CLOSING MECHANISM FOR THE BACK PRESSURE SPACE

TECHNICAL FIELD

The present disclosure relates to scroll compressors, and more particularly to a scroll compressor capable of pressing an orbiting scroll against a fixed scroll by introducing a fluid that is being compressed into a back pressure space facing the back surface of the orbiting scroll.

BACKGROUND ART

Scroll compressors in each of which a compression mechanism including an orbiting scroll and a fixed scroll is housed in a casing have been known to date. The compression mechanism includes a compression chamber formed by engaging the fixed scroll and the orbiting scroll with each other. As shown in Patent Document 1, some of such scroll compressors reduce separation between the orbiting scroll and the fixed scroll by utilizing a pressure rise in the compression chamber.

The scroll compressor shown in Patent Document 1 is connected to a refrigeration circuit of an air conditioning system. A compression mechanism of this scroll compressor has a suction port that is open at a suction position of the compression chamber, a discharge port that is open at a discharge position of the compression chamber, and an intermediate port that is open at an intermediate position between the suction position and the discharge position in the compression chamber. The suction port communicates with a low-pressure line of the refrigeration circuit, and the discharge port communicates with a high-pressure line of the refrigeration circuit.

This configuration can press an orbiting scroll against a fixed scroll by utilizing the pressure of a fluid introduced through the intermediate port from the compression chamber at the intermediate position into the back pressure space. In this manner, application of a pressing force to the orbiting scroll can reduce separation of the orbiting scroll from the fixed scroll.

CITATION LIST

Patent Document

Patent Document 1: Japanese Patent Publication No. 2010-43641

SUMMARY OF THE INVENTION

Technical Problem

In some operating states of the refrigeration circuit, the pressure of the high-pressure line in the refrigeration circuit decreases. Suppose the pressure of the high-pressure line becomes lower than that of the compression chamber at the intermediate position. In this state, when the discharge port opens, the high-pressure line and the compression chamber at the discharge position start communicating with each other to reduce the pressure of the compression chamber at the discharge position below the pressure of the compression chamber at the intermediate position.

This reduction of the pressure of the compression chamber at the discharge position to decrease reduces a separating force between the orbiting scroll and the fixed scroll. On the other hand, since the intermediate port does not communicate with the refrigeration circuit, the pressure of the compression chamber at the intermediate position hardly changes, and the pressing force on the orbiting scroll also hardly changes. Thus, there arises a problem in which the pressing force on the orbiting scroll becomes excessive due to reduction of the separating force described above.

It is therefore an object of the present disclosure to reduce an excessive force of pressing an orbiting scroll in a scroll compressor capable of pressing the orbiting scroll against a fixed scroll by utilizing the pressure of a fluid introduced from an intermediate port into a back pressure space.

Solution to the Problem

A first aspect of the present disclosure is directed to a scroll compressor including: a casing (11); and a compression chamber (31) housed in the casing (11), and including a compression chamber (31) formed by engaging a fixed scroll (40) and an orbiting scroll (35) with each other.

The scroll compressor of the first aspect further includes: a discharge port (32) located in the compression mechanism (30) and being open at a discharge position of the compression chamber (31); an intermediate port (33) located in the compression mechanism (30) and being open at an intermediate position of the compression chamber (31); a forming member (50) located in the casing (11) and including a back pressure space (56) and at least part of a fluid passage (4), the back pressure space (56) facing a back surface of the orbiting scroll (35) and communicating with the intermediate port (33), the fluid passage (4) allowing a high-pressure space (54) communicating with the discharge port (32) and the back pressure space (56) to communicate with each other; and an opening/closing mechanism (1) configured to close the fluid passage (4) when a pressure of the back pressure space (56) is lower than that of the high-pressure space (54), and open the fluid passage (4) when the pressure of the back pressure space (56) is higher than that of the high-pressure space (54).

In the first aspect, when the pressure of the back pressure space (56) is lower than that of the high-pressure space (54), a fluid is inclined to flow from the high-pressure space (54) to the back pressure space (56) in the fluid passage (4). At this time, the opening/closing mechanism (1) blocks this flow of the fluid. Accordingly, an increase in the pressure of the back pressure space (56) can be reduced, thereby reducing an excessive force of pressing the orbiting scroll (35) against the fixed scroll (40).

On the other hand, when the pressure of the back pressure space (56) becomes higher than that of the high-pressure space (54), a fluid is inclined to flow from the back pressure space (56) to the high-pressure space (54) in the fluid passage (4). At this time, the opening/closing mechanism (1) allows this flow of the fluid. Accordingly, the pressure of the back pressure space (56) can be released to the high-pressure space (54), thereby reducing an excessive force of pressing the orbiting scroll (35) against the fixed scroll (40).

In some operating states of a refrigeration circuit to which the above scroll compressor is connected, the pressure of the high-pressure space (54) becomes higher or lower than that of the back pressure space (56). Thus, the pressure of the high-pressure space (54) is not always the highest in the casing (11).

A second aspect of the present disclosure is directed to the scroll compressor of the first aspect in which the opening/closing mechanism (1) is held by a ring groove (5) that is open to the fluid passage (4) of the forming member (50), the opening/closing mechanism (1) is configured to freely expand and contract between an inner peripheral wall (6*a*) and an outer peripheral wall (6*b*) of the ring groove (5), the opening/closing mechanism (1) is constituted by a seal ring (1) including: an outer peripheral sealing surface (2*e*) that seals a gap between the back pressure space (56) and the fluid passage (4) when the seal ring (1) is at an expanded position at which the seal ring (1) is in contact with the outer peripheral wall (6*b*); and an inner peripheral sealing surface (2*f*) that seals a gap between the high-pressure space (54) and the fluid passage (4) when the seal ring (1) is at a contracted position at which the seal ring (1) is in contact with the inner peripheral wall (6*a*), and a communication part (3) allowing the high-pressure space (54) and the fluid passage (4) whose gap is sealed by the inner peripheral sealing surface (2*f*) to communicate with each other is provided in a surface of the seal ring (1) at the contracted position that is in contact with the inner peripheral wall (6*a*).

In the second aspect, the opening/closing mechanism (1) is constituted by the seal ring (1). The high-pressure space (54) is located on the inner periphery of the seal ring (1), and the back pressure space (56) is located on the outer periphery of the seal ring (1). When the pressure of the back pressure space (56) is lower than that of the high-pressure space (54), a fluid is inclined to flow from the high-pressure space (54) to the back pressure space (56) through the fluid passage (4). At this time, the pressure of the fluid inclined to flow from the high-pressure space (54) to the back pressure space (56) is applied onto the seal ring (1), and the seal ring (1) expands to come into contact with the outer peripheral wall (6*b*) of the ring groove (5). Then, when the seal ring (1) comes into contact with the outer peripheral wall (6*b*) of the ring groove (5), the outer peripheral sealing surface (2*e*) of the seal ring (1) seals a gap between the back pressure space (56) and the fluid passage (4). This sealing blocks the flow of the fluid from the high-pressure space (54) to the back pressure space (56).

On the other hand, when the pressure of the back pressure space (56) becomes higher than that of the high-pressure space (54), a fluid is inclined to flow from the back pressure space (56) to the high-pressure space (54) in the fluid passage (4). At this time, the pressure of the fluid from the back pressure space (56) to the high-pressure space (54) is applied onto the seal ring (1), and the seal ring (1) contracts to come into contact with the inner peripheral wall (6*a*) of the ring groove (5). Then, when the seal ring (1) comes into contact with the inner peripheral wall (6*a*) of the ring groove (5), the inner peripheral sealing surface (2*f*) of the seal ring (1) partially seals a gap between the high-pressure space (54) and the fluid passage (4).

Here, the communication part (3) of the seal ring (1) is a portion that is not sealed by the inner peripheral sealing surface (2*f*), and a fluid is allowed to flow from the back pressure space (56) to the high-pressure space (54) through the communication part (3).

A third aspect of the present disclosure is directed to the scroll compressor of the second aspect in which the seal ring (1) is interrupted at a position along a circumference thereof to have a first end (61) and a second end (62), and has an overlapping portion (60) in which side surfaces of the first end (61) and the second end (62) slidably overlap each other along the circumference, the first end (61) of the seal ring (1) has a counter surface facing an end surface of the second end (62) of the seal ring (1) along the circumference, and the communication part (3) of the seal ring (1) is a clearance (3) located between the counter surface of the first end (61) and the end surface of the second end (62) when the seal ring (1) is at the contracted position.

In the third aspect, the overlapping portion (60) of the seal ring (1) enables the seal ring (1) to freely radially expand and contract. In the seal ring (1), when the pressure of the back pressure space (56) is lower than that of the high-pressure space (54), the pressure of a fluid flowing from the high-pressure space (54) to the back pressure space (56) is applied from the inner peripheral side to the outer peripheral side of the seal ring (1). Then, the seal ring (1) expands such that the counter surface of the first end (61) and the end surface of the second end (62) in the seal ring (1) slide to be separated from each other along the circumference with the side surfaces of the first end (61) and the second end (62) of the seal ring (1) overlapping each other.

On the other hand, when the pressure of the back pressure space (56) becomes higher than that of the high-pressure space (54), the pressure of a fluid flowing from the back pressure space (56) to the high-pressure space (54) is applied from the outer peripheral side to the inner peripheral side of the seal ring (1). Then, the seal ring (1) contracts such that the counter surface of the first end (61) and the end surface of the second end (62) in the seal ring (1) slide to approach each other along the circumference.

The seal ring (1) is configured such that the counter surface of the first end (61) and the end surface of the second end (62) approach each other but do not come into contact with each other when the seal ring (1) contracts. Accordingly, when the seal ring (1) is at the contracted position, a clearance is formed between the counter surface of the first end (61) and the end surface of the second end (62) in the seal ring (1). This clearance serves as a communication part of the seal ring (1).

A fourth aspect of the present disclosure is directed to the scroll compressor of the first aspect in which the opening/closing mechanism (1) is held by a ring groove (5) that is open to the fluid passage (4) of the forming member (50), and the opening/closing mechanism (1) is constituted by a seal ring (1) configured to freely expand and contract between an expanded position at which the seal ring (1) is in contact with an outer peripheral wall (6*b*) of the ring groove (5) to seal a gap between the back pressure space (56) and the fluid passage (4) and a contracted position at which the seal ring (1) is separated from both of an inner peripheral wall (6*a*) and the outer peripheral wall (6*b*) of the ring groove (5) to open the fluid passage (4).

In the fourth aspect, when the pressure of the back pressure space (56) is lower than that of the high-pressure space (54), a fluid is inclined to flow from the high-pressure space (54) to the back pressure space (56) through the fluid passage (4). At this time, the pressure of the fluid inclined to flow from the high-pressure space (54) to the back pressure space (56) is applied onto the seal ring (1), and the seal ring (1) expands to come into contact with the outer peripheral wall (6*b*) of the ring groove (5). Then, when the seal ring (1) comes into contact with the outer peripheral wall (6*b*) of the ring groove (5), the seal ring (1) seals a gas between the back pressure space (56) and the fluid passage (4). This sealing blocks the flow of the fluid from the high-pressure space (54) to the back pressure space (56).

On the other hand, when the pressure of the back pressure space (56) becomes higher than that of the high-pressure space (54), a fluid is inclined to flow from the back pressure space (56) to the high-pressure space (54) in the fluid passage (4). At this time, the pressure of the fluid from the back pressure space (56) to the high-pressure space (54) is applied onto the seal ring (1), and the seal ring (1) contracts. However, the seal ring (1) does not contract 1 at which the seal ring (1) comes into contact with the inner peripheral wall (6*a*) of the ring groove (5). Thus, the seal ring (1) does not seal a gap between the high-pressure space (54) and the fluid passage (4), and the fluid is allowed to flow from the back pressure space (56) to the high-pressure space (54).

A fifth aspect of the present disclosure is directed to the scroll compressor of the first aspect in which the opening/closing mechanism (1) is held by a ring groove (5) that is open to the fluid passage (4) of the forming member (50), the opening/closing mechanism (1) is constituted by a seal ring (1) configured to freely expand and contract between an inner peripheral wall (6*a*) and an outer peripheral wall (6*b*) of the ring groove (5), seal a gap between the back pressure space (56) and the fluid passage (4) at an expanded position at which the seal ring (1) is in contact with the outer peripheral wall (6*b*), and seal a gap between the high-pressure space (54) and the fluid passage (4) at a contracted position at which the seal ring (1) is in contact with the inner peripheral wall (6*a*), the inner peripheral wall (6*a*) of the ring groove (5) has a contact portion with which the seal ring (1) at the contracted position is in contact, and a communication part (8) allowing the high-pressure space (54) and the fluid passage (4) whose gap is sealed by the seal ring (1) to communicate with each other is provided in the contact portion of the inner peripheral wall (6*a*).

In the fifth aspect, when the pressure of the back pressure space (56) is lower than that of the high-pressure space (54), a fluid is inclined to flow from the high-pressure space (54) to the back pressure space (56) through the fluid passage (4). At this time, the pressure of the fluid inclined to flow from the high-pressure space (54) to the back pressure space (56) is applied onto the seal ring (1), and the seal ring (1) expands to come into contact with the outer peripheral wall (6*b*) of the ring groove (5). Then, when the seal ring (1) comes into contact with the outer peripheral wall (6*b*) of the ring groove (5), the seal ring (1) seals a gap between the back pressure space (56) and the fluid passage (4). This sealing blocks the flow of the fluid from the high-pressure space (54) to the back pressure space (56).

On the other hand, when the pressure of the back pressure space (56) becomes higher than that of the high-pressure space (54), a fluid is inclined to flow from the back pressure space (56) to the high-pressure space (54) in the fluid passage (4). At this time, the pressure of the fluid from the back pressure space (56) to the high-pressure space (54) is applied onto the seal ring (1), and the seal ring (1) contracts to come into contact with the inner peripheral wall (6*a*) of the ring groove (5). Then, when the seal ring (1) comes into contact with the inner peripheral wall (6*a*) of the ring groove (5), the seal ring (1) partially seals a gap between the high-pressure space (54) and the fluid passage (4).

Here, the communication part (8) of the ring groove (5) is a portion that is not sealed by the seal ring (1). A fluid is allowed to flow from the back pressure space (56) to the high-pressure space (54) through the communication part (8).

Advantages of the Invention

According to the present disclosure, the back pressure space (56) and the high-pressure space (54) communicate with each other through the fluid passage (4), and the fluid passage (4) includes the opening/closing mechanism (1). This configuration can prevent the pressure of the back pressure space (56) from being higher than that of the high-pressure space (54), thereby reducing an excessive force of pressing the orbiting scroll (35) against the fixed scroll (40).

In the second aspect, when the pressure of the back pressure space (56) is lower than that of the high-pressure space (54), the seal ring (1) expands to close the fluid passage (4). On the other hand, when the pressure of the back pressure space (56) becomes higher than that of the high-pressure space (54) to cause the seal ring (1) to contract, a fluid is allowed to flow from the back pressure space (56) to the high-pressure space (54) through the communication part of the seal ring (1) and the fluid passage (4), thereby opening the fluid passage (4). In this manner, it is possible to prevent the pressure of the back pressure space (56) from being higher than that of the high-pressure space (54), thereby reducing an excessive force of pressing the orbiting scroll (35) against the fixed scroll (40).

In the third aspect, in the seal ring (1) having the overlapping portion (60), a clearance is formed between the counter surface of the first end (61) and the end surface of the second end (62) in the seal ring (1). This clearance serves as a communication part, and the communication part can be formed easily compared to a case where the communication part is formed in a portion except the overlapping portion (60).

In the fourth aspect, when the pressure of the back pressure space (56) is lower than that of the high-pressure space (54), the seal ring (1) expands to close the fluid passage (4). On the other hand, even when the pressure of the back pressure space (56) becomes higher than that of the high-pressure space (54) to cause the seal ring (1) to contract, the seal ring (1) does not come into contact with the inner peripheral wall (6a) of the ring groove (5). Thus, when the pressure of the back pressure space (56) becomes higher than that of the high-pressure space (54), a fluid is allowed to flow from the back pressure space (56) to the high-pressure space (54), thereby opening the fluid passage (4). In this manner, it is possible to prevent the pressure of the back pressure space (56) from being higher than that of the high-pressure space (54), thereby reducing an excessive force of pressing the orbiting scroll (35) against the fixed scroll (40).

In the fifth aspect, when the pressure of the back pressure space (56) is lower than that of the high-pressure space (54), the seal ring (1) expands to close the fluid passage (4). On the other hand, when the pressure of the back pressure space (56) becomes higher than that of the high-pressure space (54) to cause the seal ring (1) to contract, a fluid is allowed to flow from the back pressure space (56) to the high-pressure space (54) through the communication part of the ring groove (5) and the fluid passage (4), thereby opening the fluid passage (4). In this manner, it is possible to prevent the pressure of the back pressure space (56) from being higher than that of the high-pressure space (54), thereby reducing an excessive force of pressing the orbiting scroll (35) against the fixed scroll (40).

BRIEF DESCRIPTION OF THE DRAWINGS

FIG. 6A illustrates a flow of the refrigerant when the seal ring expands, and FIG. 6B illustrates a flow of the refrigerant when the seal ring contracts.

FIG. 9A illustrates a state in which the back pressure is higher than the high pressure, and FIG. 9B illustrates a state in which an increase in the back pressure is reduced.

FIG. 10A is a view when the seal ring expands, and FIG. 10B is a view when the seal ring contracts.

FIG. 11A illustrates a flow of the refrigerant when the seal ring expands, and FIG. 11B illustrates a flow of the refrigerant when the seal ring contracts.

FIG. 13A is a perspective view, and FIG. 13B is a top view.

FIG. 18A is a perspective view, and FIG. 18B is a view illustrating a flow of a refrigerant when the seal ring contracts.

FIG. 19B is a top view.

DESCRIPTION OF EMBODIMENTS

An embodiment of the present disclosure will be described hereinafter with reference to the drawings.

Figure 1:
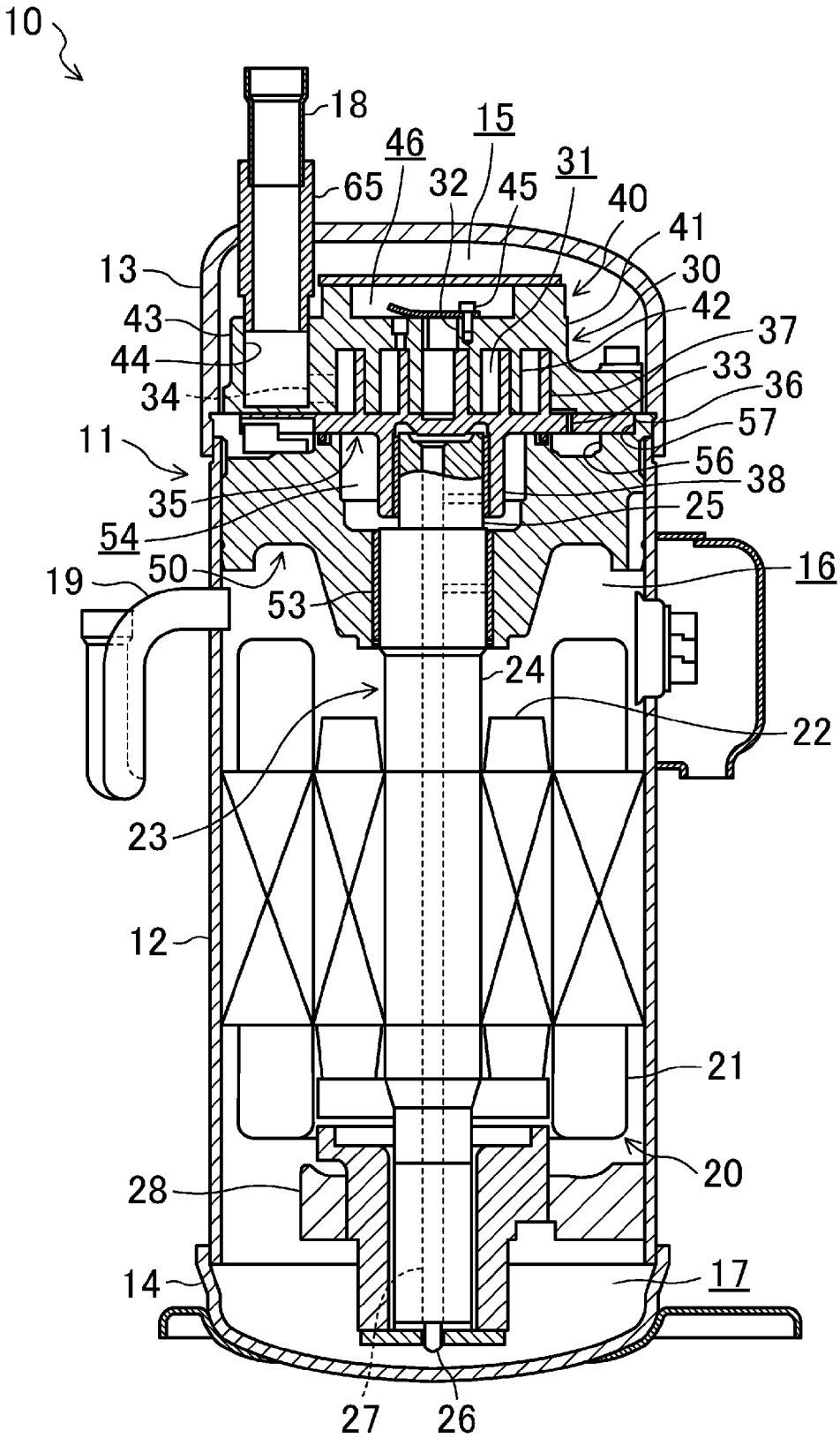
FIG. 1 is a longitudinal sectional view illustrating a scroll compressor according to an embodiment.
Figure 2:
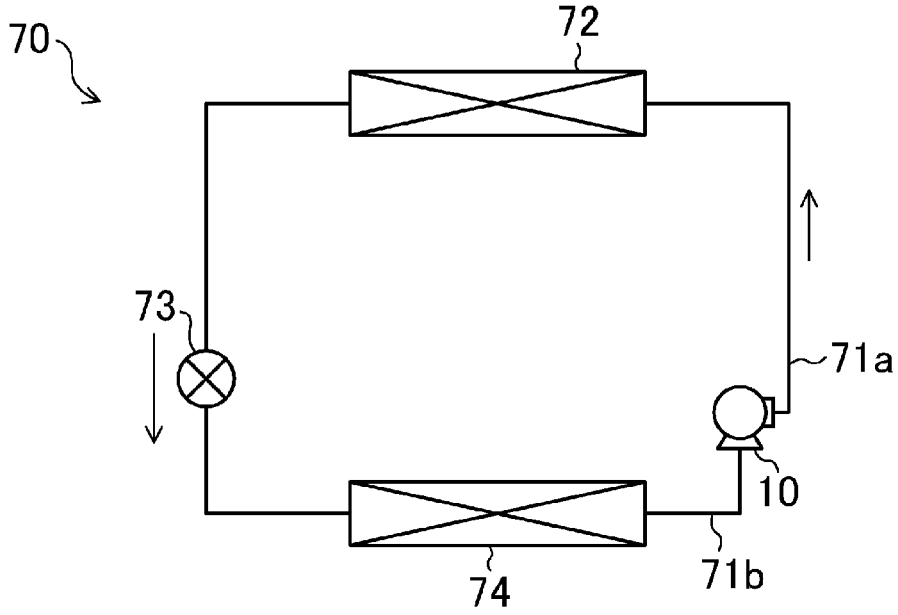
FIG. 2 is a view illustrating a refrigeration circuit of an air conditioning system to which the scroll compressor is connected.

FIG. 1 is a view illustrating a scroll compressor (10) according to this embodiment. The scroll compressor (hereinafter referred to as a compressor) (10) is connected to a refrigeration circuit (70) that performs a refrigeration cycle of a vapor compression type in an air conditioning system as illustrated in, for example, FIG. 2. The compressor (10) includes a casing (11), a rotary compression mechanism (a compression mechanism) (30), and a motor (20).

The refrigeration circuit (70) is a closed circuit in which the compressor (10), a condenser (72), an expansion valve (73), and an evaporator (74) are sequentially connected together by a refrigerant piping. The refrigerant piping includes: a high-pressure line (71*a*) extending from a discharge side of the scroll compressor (10) and connected to an inlet of expansion valve (73) through the condenser (72); and a low-pressure line (71*b*) extending from an outlet of the expansion valve (73) and connected to a suction side of the scroll compressor (10) through the evaporator (74).

<Casing>

The casing (11) is a vertically oriented cylindrical sealed container whose both ends are closed, and includes a cylindrical body (12), an upper end plate (13) fixed to the upper end of the body (12), and a lower end plate (14) fixed to the lower end of the body (12).

The internal space of the casing (11) is divided into upper and lower space by a bearing housing (50) coupled to the inner peripheral surface of the casing (11). The upper space, i.e., part of the internal space located above the bearing housing (50), is an upper space (15), and the lower space, i.e., part of the internal space located below the bearing housing (50) is a lower space (16). The configuration of the bearing housing (50) will be described in detail below. An oil reservoir (17) configured to store lubricating oil for lubricating a sliding part of the scroll compressor (10) is provided at the bottom of the lower space (16) in the casing (11).

The casing (11) is provided with a suction pipe (18) and a discharge pipe (19). The suction pipe (18) penetrates an upper portion of the upper end plate (13). An end of the suction pipe (18) is connected to a suction pipe fitting (65) of the rotary compression mechanism (30). The discharge pipe (19) penetrates the body (12). An end of the discharge pipe (19) is open to the lower space (16) of the casing (11).

<Motor>

The motor (20) is housed in the lower space (16) of the casing (11). The motor (20) includes a cylindrical stator (21) and a cylindrical rotor (22). The stator (21) is fixed to the body (12) of the casing (11). The rotor (22) is disposed in a hollow portion of the stator (21). In the hollow portion of the rotor (22), a driving shaft (23) is fixed to penetrate the rotor (22) such that the rotor (22) and the driving shaft (23) integrally rotate.

The driving shaft (23) includes a main shaft portion (24) and an eccentric portion (25) located above the main shaft portion (24). The main shaft portion (24) and the eccentric portion (25) are integrally formed. The eccentric portion (25) has a diameter smaller than the maximum diameter of the main shaft portion (24). The shaft center of the eccentric portion (25) is eccentric to the shaft center of the main shaft portion (24) by a predetermined distance. The lower end of the main shaft portion (24) in the driving shaft (23) is rotatably supported by a lower bearing part (28) fixed to a portion of the casing (11) near the lower end of the body (12). The upper end of the main shaft portion (24) is rotatably supported by a bearing part (53) of the bearing housing (50).

An oil supply pump (26) is provided at the lower end of the driving shaft (23). An inlet of the oil supply pump (26) is open to the oil reservoir (17) of the casing (11). An outlet of the oil supply pump (26) is connected to an oil supply passage (27) provided in the driving shaft (23). Lubricating oil sucked from the oil reservoir (17) of the casing (11) by the oil supply pump (26) is supplied to a sliding part of the compressor (10).

<Rotary Compression Mechanism>

The rotary compression mechanism (30) is a so-called rotary compression mechanism of a scroll type including an orbiting scroll (35), a fixed scroll (40), and a bearing housing (50). The bearing housing (50) and the fixed scroll (40) are bolted together, and the orbiting scroll (35) is housed to revolve between the bearing housing (50) and the fixed scroll (40).

—Orbiting Scroll—

The orbiting scroll (35) includes a substantially disk-shaped movable end plate (36). A movable lap (37) stands on the upper surface (hereinafter referred to as a front surface) of the movable end plate (36). The movable lap (37) is a spiral-shaped wall extending radially outward from a position near the center of the movable end plate (36). A boss (38) projects from the lower surface (hereinafter referred to as a back surface) of the movable end plate (36).

In the movable end plate (36), a through hole is formed at the outer periphery of the outermost wall of the movable lap (37) to vertically penetrate the movable end plate (36). This through hole constitutes an intermediate port (33). The intermediate port (33) is open at an intermediate position of a compression chamber (31) of the rotary compression mechanism (30). This compression chamber (31) will be described later.

—Fixed Scroll—

The fixed scroll (40) includes a substantially disk-shaped fixed end plate (41). A fixed lap (42) stands on the lower surface (hereinafter referred to as a front surface) of the fixed end plate (41). The fixed lap (42) is a spiral-shaped wall extending radially outward from a position near the center of the fixed end plate (41), and is engaged with the movable lap (37) of the orbiting scroll (35). The compression chamber (31) is formed between the fixed lap (42) and the movable lap (37).

The fixed scroll (40) includes an outer edge (43) continuously extending radially outward from the outermost wall of the fixed lap (42). The lower end surface of the outer edge (43) is fixed to the upper end surface of the bearing housing (50). The outer edge (43) has an opening (44) that is open upward. A communication hole allowing the inside of the opening (44) and the outermost end of the compression chamber (31) to communicate with each other is formed in the outer edge (43). This communication hole constitutes a suction port (34). The suction port (34) is open at the suction position of the compression chamber (31). The opening (44) of the outer edge (43) is connected to the above-described suction pipe fitting (65).

In the fixed end plate (41) of the fixed scroll (40), a through hole is formed at a position near the center of the fixed lap (42) to vertically penetrate the fixed end plate (41). This through hole constitutes a discharge port (32). The lower end of the discharge port (32) is open at the discharge position of the compression chamber (31). The upper end of the discharge port (32) is open to a discharge chamber (46) defined in an upper portion of the fixed scroll (40). A discharge reed valve (45) for opening and closing the upper-end opening of the discharge port (32) is attached to the bottom surface of the discharge chamber (46). Although not shown, the discharge chamber (46) communicates with the lower space (16) of the casing (11).

—Bearing Housing—

The bearing housing (50) has a substantially cylindrical shape, and includes the orbiting scroll (35) to constitute a forming member. The outer peripheral surface of the bearing housing (50) is tapered, i.e., has its diameter gradually decrease, from the top to the bottom thereof. The upper portion of this outer peripheral surface is fixed to the inner peripheral surface of the casing (11)

The driving shaft (23) is inserted in the hollow portion of the bearing housing (50). This hollow portion is tapered, i.e., has its diameter gradually decrease, from the top to the bottom thereof. The bearing part (53) is formed in a lower portion of the hollow portion. This bearing part (53) rotatably supports the upper end of the main shaft portion (24) of the driving shaft (23). The upper portion of the hollow portion constitutes a high-pressure space (54). The high-pressure space (54) faces the back surface of the orbiting scroll (35). The boss (38) of the orbiting scroll (35) is located in the high-pressure space (54). The boss (38) is engaged with the eccentric portion (25) of the driving shaft (23) projecting from the upper end of the bearing part (53).

An end of the oil supply passage (27) of the driving shaft (23) is open at the outer peripheral surface of the eccentric portion (25). Lubricating oil is supplied from the end of the oil supply passage (27) to a clearance between the boss (38) and the eccentric portion (25). The lubricating oil supplied to the clearance also flows into the high-pressure space (54). Accordingly, the high-pressure space (54) comes to be in an atmosphere at the same pressure as in the lower space (16) of the casing (11). Then, the pressure of the high-pressure space (54) is applied onto the back surface of the orbiting scroll (35) to press the orbiting scroll (35) against the fixed scroll (40).

An opening (57) into which the movable end plate (36) of the orbiting scroll (35) is fitted, is formed in the upper end surface of the bearing housing (50). An annular recess (56) is formed in the bottom surface of the opening (57). The internal space of the recess (56) constitutes a back pressure space (56). The back pressure space (56) faces the back surface of the orbiting scroll (35). The intermediate port (33) of the orbiting scroll (35) is open to the back pressure space (56). The pressure of the compression chamber (31) at the intermediate position is applied onto the back surface of the orbiting scroll (35) through the intermediate port (33) to press the orbiting scroll (35) against the fixed scroll (40).

Figure 3:
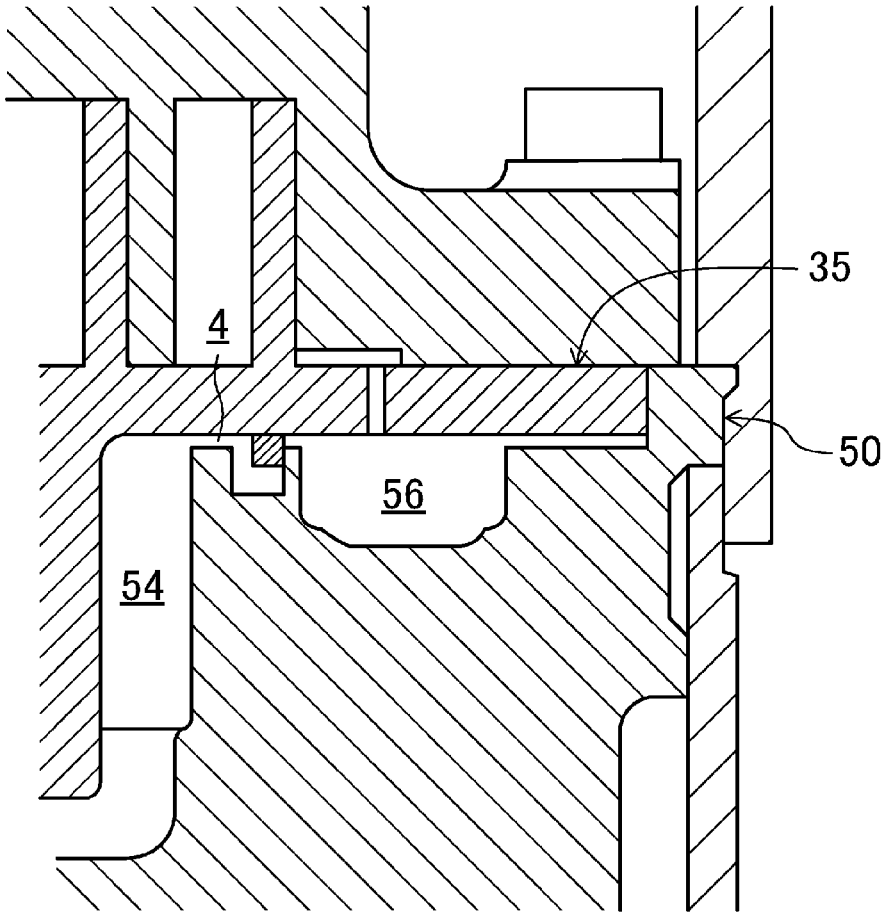
FIG. 3 is an enlarged view illustrating a portion around the back surface of an orbiting scroll.

FIG. 3 is an enlarged view illustrating a portion around the back surface of the orbiting scroll (35). As illustrated in FIG. 3, a fluid passage (4) through which the high-pressure space (54) and the back pressure space (56) communicate with each other is formed between the bearing housing (50) and the back surface of the orbiting scroll (35). This fluid passage (4) has an annular shape. An end of the inner periphery of the fluid passage (4) is open to the high-pressure space (54), and an end of the outer periphery of the fluid passage (4) is open to the back pressure space (56).

—Ring Groove and Seal Ring—

Figure 4:
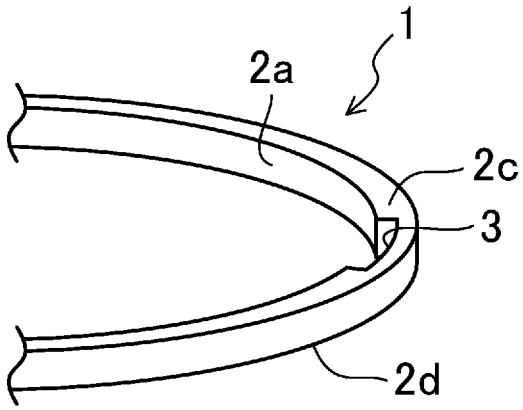
FIG. 4 is a perspective view illustrating part of a seal ring of the embodiment.

A ring groove (5) that is open to the fluid passage (4) is formed on the bottom surface of the opening (57) formed in the bearing housing (50). The ring groove (5) holds a seal ring (1) that is rectangular in cross section. The seal ring (1) constitutes an opening/closing mechanism, has its width smaller than the groove width of the ring groove (5), and is configured to freely radially expand and contract between an inner peripheral wall (6*a*) and an outer peripheral wall (6*b*) of the ring groove (5). As illustrated in FIG. 4, in the inner peripheral surface (2*a*) of the seal ring (1), an cutout portion (3) is formed by cutting out a portion of the seal ring (1) from an upper surface (2*c*) to a lower surface (2*d*) thereof. This cutout portion (3) constitutes a communication part.

Figure 5:
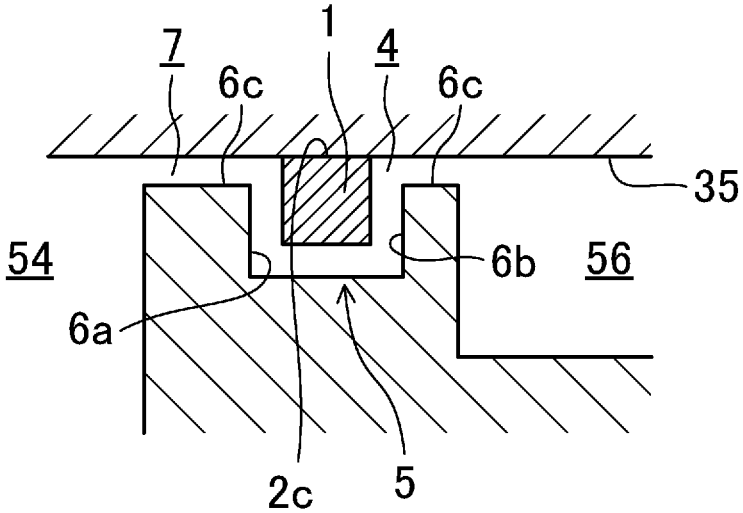
FIG. 5 is a longitudinal sectional view illustrating a portion around the seal ring of the scroll compressor.

FIG. 5 is a longitudinal sectional view illustrating a portion around the seal ring (1) in the rotary compression mechanism (30). FIG. 5 illustrates a state in which a small clearance (7) is formed between the back surface of the orbiting scroll (35) and end surfaces (6*c*) of the inner peripheral wall (6*a*) and the outer peripheral wall (6*b*) of the ring groove (5) by pressing the orbiting scroll (35) against the fixed scroll (40).

A leaf spring, not shown, is located below the seal ring (1). This leaf spring biases the seal ring (1) toward the orbiting scroll (35). In this manner, even in a case where the small clearance (7) is formed between the back surface of the orbiting scroll (35) and the end surfaces (6*c*) of the inner peripheral wall (6*a*) and the outer peripheral wall (6*b*) of the ring groove (5), it is possible to constantly bring the upper surface (2*c*) of the seal ring (1) into contact with the back surface of the orbiting scroll (35).

—Operation—

Operation of the above-described compressor (10) will now be described.

When the motor (20) of the compressor (10) is powered on, the rotor (22) and the driving shaft (23) rotate, and the orbiting scroll (35) eccentrically rotates about the shaft center of the driving shaft (23). With this eccentric rotation of the orbiting scroll (35), the volume of the compression chamber (31) periodically increases and decreases.

Specifically, when the driving shaft (23) rotates, the volume of the compression chamber (31) starts increasing, and the suction port (34) becomes open, resulting in that a refrigerant in the refrigeration circuit (70) is sucked into the compression chamber (31). When the driving shaft (23) makes one rotation, the suction port (34) is closed to close the compression chamber (31) completely, thereby finishing the increase in the volume of compression chamber (31).

Then, when the driving shaft (23) further rotates, the volume of the compression chamber (31) starts decreasing, and compression of the refrigerant in the compression chamber (31) starts. In the middle of the decrease in the volume of the compression chamber (31), the intermediate port (33) opens. Then, part of the refrigerant that is being compressed in the compression chamber (31) is introduced into the back pressure space (56) through the intermediate port (33). The pressure of the refrigerant in the back pressure space (56) presses the orbiting scroll (35) against the fixed scroll (40).

Thereafter, the volume of the compression chamber (31) further decreases, thereby closing the intermediate port (33). After the closure of the intermediate port (33), the volume of the compression chamber (31) continues to decrease. When the volume of the compression chamber (31) decreases to a predetermined volume, the discharge port (32) opens. The refrigerant compressed in the compression chamber (31) is discharged to the discharge chamber (46) of the fixed scroll (40) through the discharge port (32). The refrigerant in the discharge chamber (46) is discharged from the discharge pipe (19) to the refrigeration circuit (70) through the lower space (16) of the casing (11). As described above, the lower space (16) communicates with the high-pressure space (54), and the pressure of the refrigerant in the high-pressure space (54) presses the orbiting scroll (35) against the fixed scroll (40).

Operation of the seal ring (1) will now be described.

Figure 6A:
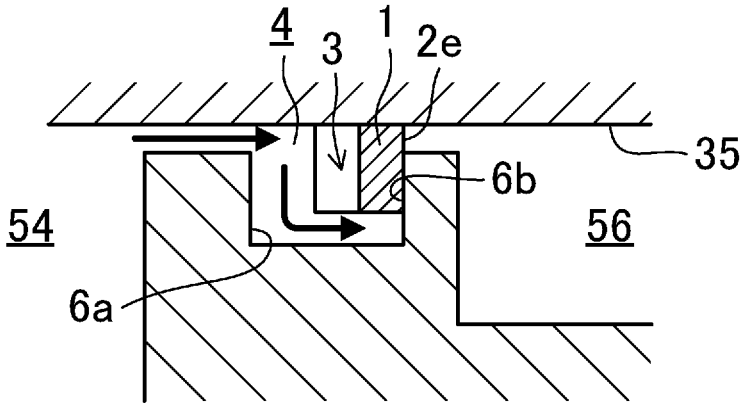
FIGS. 6A and 6B are vies illustrating flows of a refrigerant in a fluid passage in the embodiment.

In the air conditioning system, when the pressure of the high-pressure line (71*a*) in the refrigeration circuit (70) is higher than that of the compression chamber (31) at the intermediate position, a refrigerant in the high-pressure space (54) communicating with the high-pressure line (71*a*) is inclined to flow into the back pressure space (56) communicating with the compression chamber (31) at the intermediate position. At this time, the pressure of the refrigerant inclined to flow from the high-pressure space (54) into the back pressure space (56) is applied onto the seal ring (1), and as illustrated in FIG. 6A, the seal ring (1) expands to come into contact with the outer peripheral wall (6*b*) of the ring groove (5). Then, when the seal ring (1) comes into contact with the outer peripheral wall (6*b*) of the ring groove (5), an outer peripheral sealing surface (2*e*) of the seal ring (1) seals a gap between the back pressure space (56) and the fluid passage (4). This sealing blocks the flow of the refrigerant from the high-pressure space (54) to the back pressure space (56).

On the other hand, in some operating states of the refrigeration circuit (70), the pressure of the high-pressure line (71*a*) in the refrigeration circuit (70) is lower than that of the compression chamber (31) at the intermediate position.

Figure 6B:
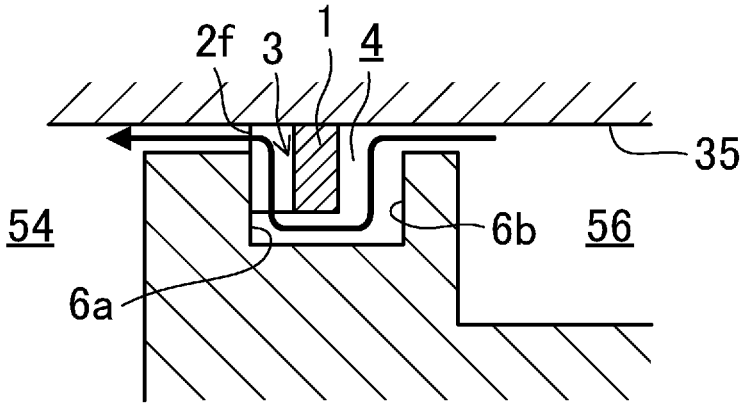

In this case, a refrigerant is inclined to flow from the back pressure space (56) to the high-pressure space (54) in the fluid passage (4). At this time, the pressure of the refrigerant from the back pressure space (56) to the high-pressure space (54) is applied onto the seal ring (1), and as illustrated in FIG. 6B, the seal ring (1) contracts to come into contact with the inner peripheral wall (6*a*) of the ring groove (5). Then, when the seal ring (1) comes into contact with the inner peripheral wall (6*a*) of the ring groove (5), an inner peripheral sealing surface (2*f*) of the seal ring (1) partially seals a gap between the high-pressure space (54) and the fluid passage (4).

The cutout portion (3) of the seal ring (1) is a portion that is not sealed by the inner peripheral sealing surface (2*f*), and the refrigerant is allowed to flow from the back pressure space (56) and the high-pressure space (54) through the cutout portion (3).

—Advantages of Embodiment—

In this embodiment, the seal ring (1) is provided in the fluid passage (4) allowing the back pressure space (56) and the high-pressure space (54) to communicate with each other. When the pressure of the back pressure space (56) is lower than that of the high-pressure space (54), the seal ring (1) expands to close the fluid passage (4).

On the other hand, when the pressure of the back pressure space (56) becomes higher than that of the high-pressure space (54) to cause the seal ring (1) to contract, a refrigerant is allowed to flow from the back pressure space (56) to the high-pressure space (54) through the cutout portion (3) of the seal ring (1) and the fluid passage (4), thereby opening the fluid passage (4).

As described above, it is possible to prevent the pressure of the back pressure space (56) from being higher than that of the high-pressure space (54), thereby reducing an excessive force of pressing the orbiting scroll (35) against the fixed scroll (40).

Figure 7:
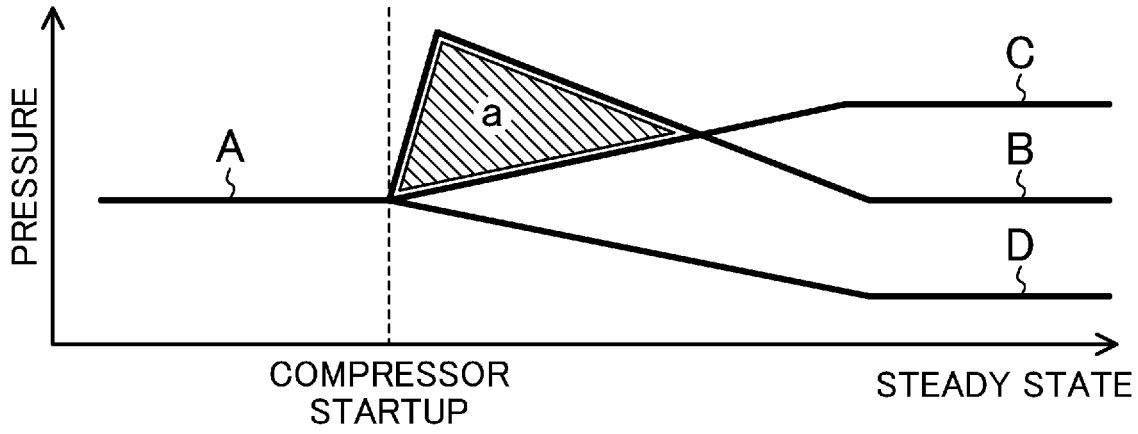
FIG. 7 shows a relationship among a back pressure, a high pressure, and a low pressure in the embodiment.

Specifically, as shown in FIG. 7, for example, before startup of the scroll compressor (10), all the positions in the casing (11) are at a pressure A. That is, a back pressure B, which is the pressure of the back pressure space (56), a high pressure C, which is the pressure of the high-pressure space (54), and a low pressure D, which is the pressure of the suction port (34), are the same pressure.

When the compressor (10) starts up, the back pressure B immediately rises. That is, since the back pressure space (56) communicates with the compression chamber (31) through the intermediate port (33) and the back pressure B has been set at a predetermined magnification of the low pressure D, the back pressure B rises immediately after the startup.

On the other hand, since the high pressure C depends on the refrigeration circuit (70), which is a system path, the high pressure C rises with a delay after the rise of the back pressure B. In particular, in a large-scale system, the delay in a rise of the high pressure C is conspicuous.

Consequently, in a region a immediately after startup of the compressor (10), the back pressure B exceeds the high pressure C.

In this embodiment, when the pressure of the back pressure space (56) becomes higher than that of the high-pressure space (54), a refrigerant flows from the back pressure space (56) to the high-pressure space (54) through the cutout portion (3) and the fluid passage (4). As a result, in this embodiment, an excessive increase in the back pressure B can be reduced, thereby enhancing the reliability.

In addition, since the back pressure B is higher than the pressure (the discharge pressure) of the oil reservoir (17)

immediately after startup of the compressor (10), an oil supply delay might occur to cause a shortage of lubricating oil in a thrust part such as a sliding surface between the fixed scroll (40) and the orbiting scroll (35). However, in this embodiment, reduction of a rise of the back pressure B can further enhance the reliability.

Moreover, in normal operation of the compressor (10), when the pressure difference between the high pressure and the low pressure is small, a pressure rise of the back pressure space (56) can be reduced.

Figure 8:
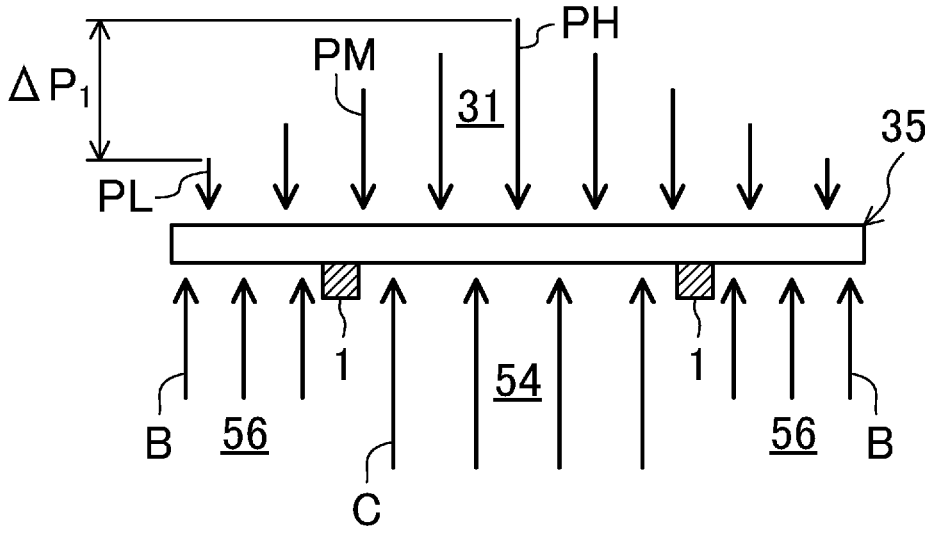
FIG. 8 is a view illustrating a pressure relationship on the orbiting scroll when the pressure difference between the high pressure and the low pressure is large in the embodiment.

Specifically, as illustrated in FIG. 8, when a pressure difference ΔP1 between the high pressure (i.e., the condensing pressure) and the low pressure (i.e., the evaporating pressure) is large, the refrigerant is compressed in the compression chamber (31) to sequentially have a low pressure PL, an intermediate pressure PM, and then a high pressure PH. The high-pressure space (54) comes to have the high pressure C, and the back pressure space (56) comes to have the back pressure B, which is the intermediate pressure.

Figure 9A:
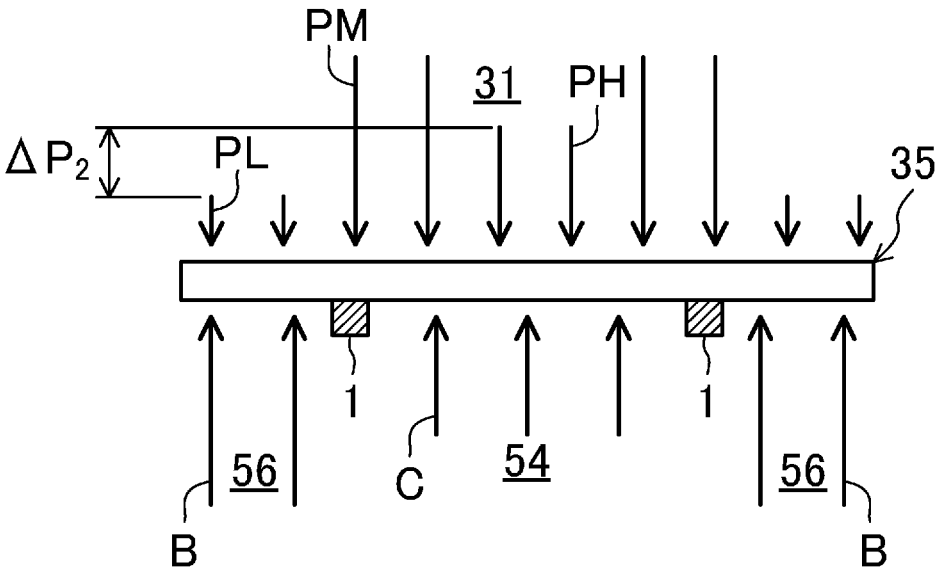
FIGS. 9A and 9B are views illustrating a pressure relationship on the orbiting scroll when the pressure difference between the high pressure and the low pressure is small in the embodiment.

On the other hand, as illustrated in FIG. 9A, when a pressure difference ΔP2 between the high pressure (i.e., the condensing pressure) and the low pressure (i.e., the evaporating pressure) is small, the pressure of the refrigerant increases from the low pressure PL to the intermediate pressure PM in the compression chamber (31). However, after the refrigerant have been discharged from the compression chamber (31), the pressure thereof decreases to the condensing pressure, and thus, the high pressure PH becomes lower than the intermediate pressure PM. In this case, the back pressure B of the back pressure space (56) becomes the intermediate pressure PM, which is higher than that of the high-pressure space (54). Consequently, a pressing force applied onto the orbiting scroll (35) becomes excessive. Then, a thrust loss at the outer periphery of the orbiting scroll (35) increases.

Figure 9B:
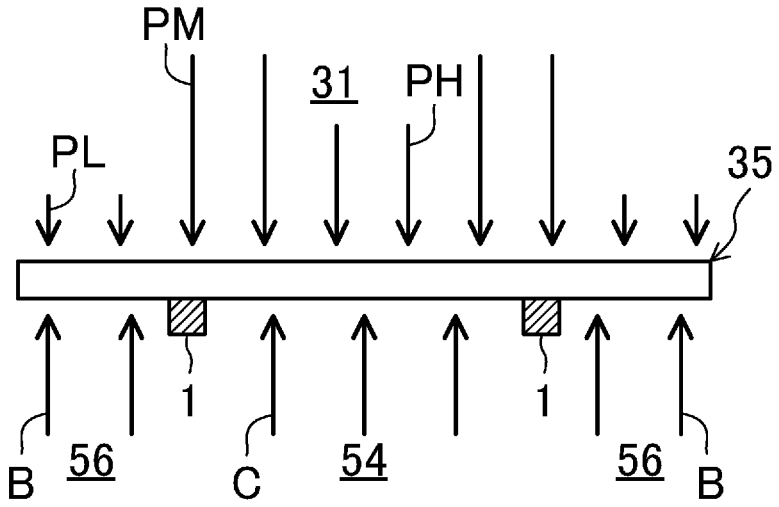

On the other hand, in this embodiment, as illustrated in FIG. 9B, when the pressure of the back pressure space (56) becomes higher than that of the high-pressure space (54), the refrigerant flows from the back pressure space (56) to the high-pressure space (54) through the cutout portion (3) and the fluid passage (4), thereby making the back pressure and the high pressure equal to each other. Consequently, an excessive rise of the back pressure B can be reduced, thereby enhancing the reliability. In addition, a thrust loss at the outer periphery of the orbiting scroll (35) can be reduced.

That is, the pressure of the back pressure space (56) automatically switches between the intermediate pressure (with a constant magnification of the low pressure) and the discharge pressure (the high pressure) depending on the operating state.

—First Variation of Embodiment—

Figure 10A:
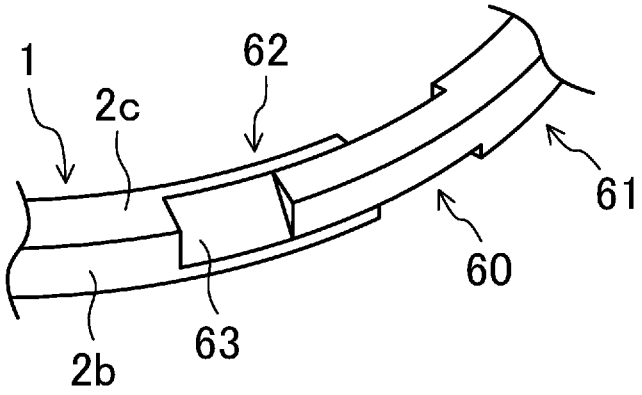
FIGS. 10A and 10B are perspective views illustrating a seal ring according to a first variation of the embodiment.

The seal ring (1) according a first variation illustrated in FIG. 10A has a first end (61) and a second end (62) formed by interrupting the seal ring (1) at an arbitrary position along the circumference. Specifically, the first end (61) is one end (61) of the seal ring (1), and the second end (62) is the other end (62) of the seal ring (1). The side surfaces of the first end (61) and the second end (62) slidably overlap each other along the circumference, thereby enabling the seal ring (1) to expand and contract radially. A portion where the side surfaces of the first end (61) and the second end (62) overlap each other constitutes an overlapping portion (60) of the seal ring (1). A slide surface (63) on which the side surfaces of the first end (61) and the second end (62) slide is a slope extending from the upper surface (2*c*) to an outer peripheral surface (2*b*) of the seal ring (1). This configuration can easily interrupt (divide) the seal ring (1), thereby enabling easy fabrication of the seal ring (1).

Figure 10B:
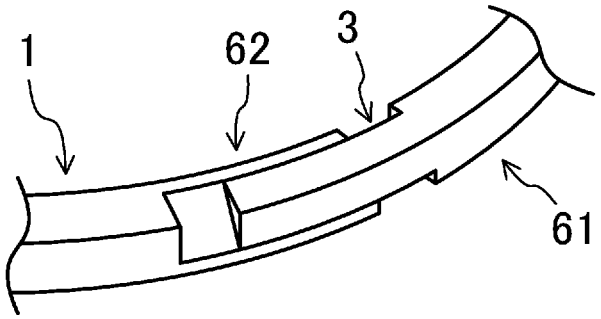

As illustrated in FIG. 10B, when the seal ring (1) contracts, a clearance (3) is formed between the counter surface, i.e., the surface facing an end surface of the second end (62), of the first end (61) and the end surface of the second end (62). This clearance (3) constitutes a communication part (3) of the seal ring (1) in the embodiment. In this manner, the communication part (3) can be formed easily compared to a case where the communication part (3) is formed in a portion except the overlapping portion (60).

Figure 11A:
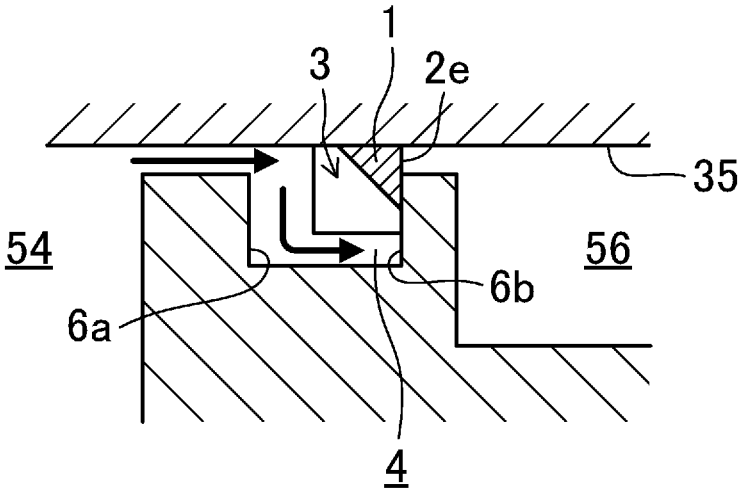
FIGS. 11A and 11B illustrate flows of a refrigerant in a fluid passage in the first variation of the embodiment.

When the pressure of the back pressure space (56) is lower than that of the high-pressure space (54), as illustrated in FIG. 11A, the seal ring (1) expands, and the outer peripheral sealing surface (2*e*) of the seal ring (1) seals a gap between the back pressure space (56) and the fluid passage (4). This sealing blocks a refrigerant flow from the high-pressure space (54) to the back pressure space (56).

Figure 11B:
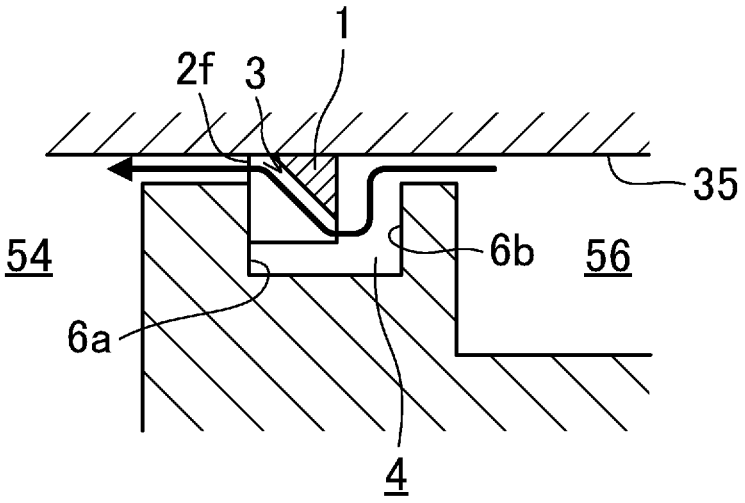

On the other hand, when the pressure of the back pressure space (56) is higher than that of the high-pressure space (54), as illustrated in FIG. 11B, the seal ring (1) contracts to come into contact with the inner peripheral wall (6*a*) of the ring groove (5), and an inner peripheral sealing surface (2*f*) of the seal ring (1) partially seals a gap between the high-pressure space (54) and the fluid passage (4). The clearance (3) of the seal ring (1) is the portion that is not sealed by the inner peripheral sealing surface (2*f*), and a refrigerant is allowed to flow from the back pressure space (56) to the high-pressure space (54) through the clearance (3). The other parts of the configuration, operation, and advantages are the same as those in the embodiment.

—Second Variation of Embodiment—

The seal ring (1) according to a second variation is configured such that the diameter of the inner peripheral surface (2*a*) when the seal ring (1) contracts most is larger than the diameter of the inner peripheral wall (6*a*) of the ring groove (5), and the diameter of the outer peripheral surface (2*b*) when the seal ring (1) contracts most is smaller than the diameter of the outer peripheral wall (6*b*) of the ring groove (5).

In this second variation, in the air conditioning system, when the pressure of the high-pressure line (71*a*) of the refrigeration circuit (70) is higher than that of the compression chamber (31) at the intermediate position, the pressure of the high-pressure space (54) communicating with the high-pressure line (71*a*) is higher than that of the back pressure space (56) communicating with the compression chamber (31) at the intermediate position. Thus, in the same manner as in the embodiment, the seal ring (1) expands to come into contact with the outer peripheral wall (6*b*) of the ring groove (5). Then, when the seal ring (1) comes into contact with the outer peripheral wall (6*b*) of the ring groove (5), the outer peripheral sealing surface (2*e*) of the seal ring (1) seals a gap between the back pressure space (56) and the fluid passage (4). This sealing blocks a refrigerant flow from the high-pressure space (54) to the back pressure space (56).

Figure 12:
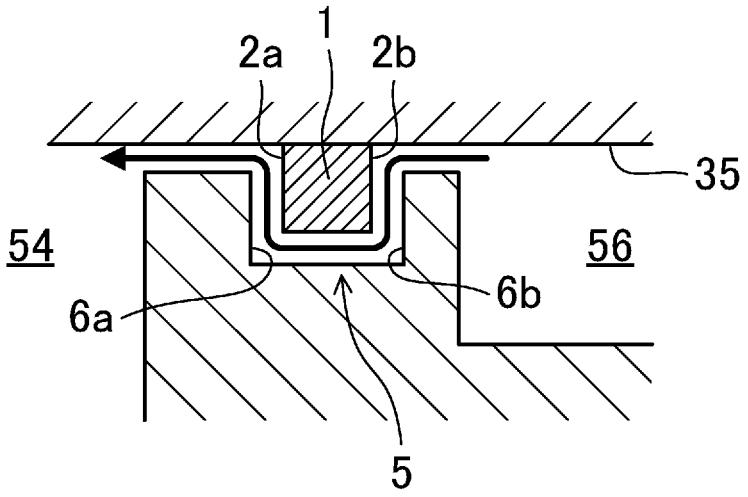
FIG. 12 is a view illustrating a flow of a refrigerant in a fluid passage according to a second variation of the embodiment when the seal ring contracts.

On the other hand, in some operating states of the refrigeration circuit (70), the pressure of the high-pressure line (71*a*) of the refrigeration circuit (70) is lower than that of the compression chamber (31) at the intermediate position. In this case, a refrigerant is inclined to flow from the back pressure space (56) to the high-pressure space (54) in the fluid passage (4). At this time, the pressure of the refrigerant inclined to flow from the back pressure space (56) to the high-pressure space (54) is applied onto the seal ring (1), and the seal ring (1) contracts. However, as illustrated in FIG. 12, the seal ring (1) is configured not to contract to a degree at which the seal ring (1) comes into contact with the inner peripheral wall (6*a*) of the ring groove (5). Thus, the seal ring (1) does not seal a gap between the high-pressure space (54)

and the fluid passage (4) to allow a refrigerant to flow from the back pressure space (56) to the high-pressure space (54). In this manner, when the pressure of the back pressure space (56) becomes higher than that of the high-pressure space (54), the fluid passage (4) can be made open.

In the manner described above, it is possible to prevent the pressure of the back pressure space (56) from being higher than that of the high-pressure space (54), thereby reducing an excessive force of pressing the orbiting scroll (35) against the fixed scroll (40). The other parts of the configuration, operation, and advantages are the same as those in the embodiment.

—Third Variation of Embodiment—

Figure 13A:
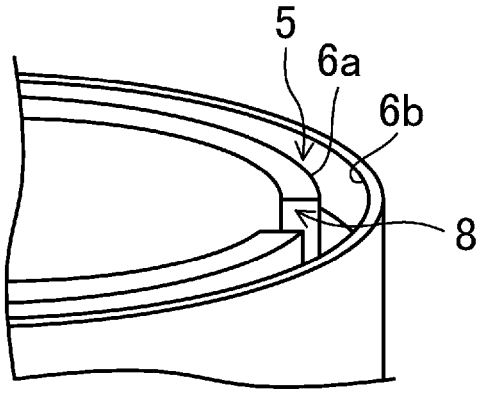
FIGS. 13A and 13B are views illustrating a ring groove according to a third variation of the embodiment.
Figure 13B:
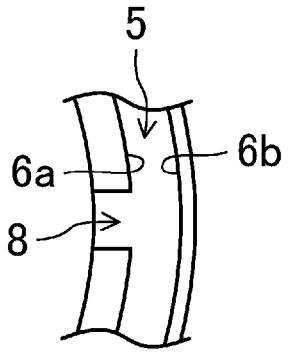

In the embodiment, the seal ring (1) has the communication part (3). In a third variation, a communication part (8) is provided in the ring groove (5) instead of the seal ring (1), as illustrated in FIGS. 13A and 13B. Specifically, the inner peripheral wall (6*a*) of the ring groove (5) has a contact portion with which the seal ring (1) comes into contact when the seal ring (1) contracts. The inner peripheral wall (6*a*) has a cutout portion (8) with a shape formed by cutting out this contact portion into a rectangle shape. This cutout portion (8) constitutes the communication part (8) of the ring groove (5).

In the third variation, in the air conditioning system, when the pressure of the high-pressure line (71*a*) of the refrigeration circuit (70) is higher than that of the compression chamber (31) at the intermediate position, the pressure of the high-pressure space (54) communicating with the high-pressure line (71*a*) is higher than that of the back pressure space (56) communicating with the compression chamber (31) at the intermediate position. Thus, in the same manner as in the embodiment, the seal ring (1) expands to a degree at which the seal ring (1) comes into contact with the outer peripheral wall (6*b*) of the ring groove (5). Then, when the seal ring (1) comes into contact with the outer peripheral wall (6*b*) of the ring groove (5), the outer peripheral sealing surface (2*e*) of the seal ring (1) seals a gap between the back pressure space (56) and the fluid passage (4). This sealing blocks a refrigerant flow from the high-pressure space (54) to the back pressure space (56).

Figure 14:
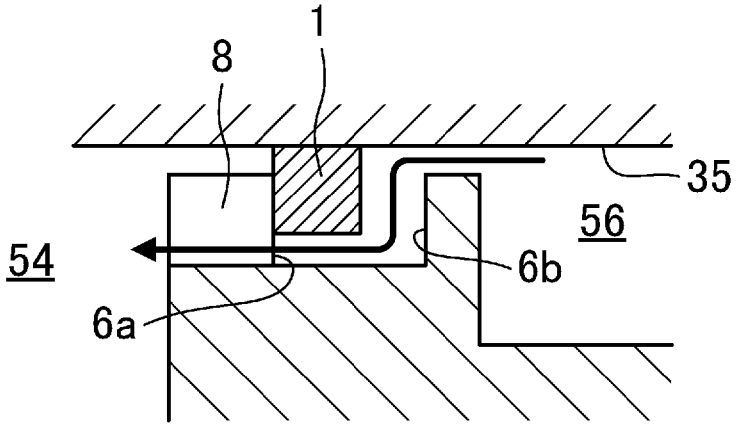
FIG. 14 is a view illustrating a flow of a refrigerant in a fluid passage according to a third variation of the embodiment when the seal ring contracts.

On the other hand, in some operating states of the refrigeration circuit (70), the pressure of the high-pressure line (71*a*) of the refrigeration circuit (70) is lower than that of the compression chamber (31) at the intermediate position. In this case, a refrigerant is inclined to flow from the back pressure space (56) to the high-pressure space (54) in the fluid passage (4). At this time, the pressure of the refrigerant inclined to flow from the back pressure space (56) to the high-pressure space (54) is applied onto the seal ring (1), and the seal ring (1) contracts to come into contact with the inner peripheral wall (6*a*) of the ring groove (5). Then, when the seal ring (1) comes into contact with the inner peripheral wall (6*a*) of the ring groove (5), the seal ring (1) partially seals a gap between the high-pressure space (54) and the fluid passage (4). The cutout portion (8) of the ring groove (5) is a portion that is not sealed by the seal ring (1), and as illustrated in FIG. 14, a fluid is allowed to flow from the back pressure space (56) to the high-pressure space (54) through the cutout portion (8).

In this manner, when the pressure of the back pressure space (56) becomes higher than that of the high-pressure space (54), the fluid passage (4) can be made open. Thus, it is possible to prevent the pressure of the back pressure space (56) from being higher than that of the high-pressure space (54), thereby reducing an excessive force of pressing the orbiting scroll (35) against the fixed scroll (40). The other parts of the configuration, operation, and advantages are the same as those in the embodiment.

—Fourth Variation of Embodiment—

In the embodiment, the seal ring (1) constitutes the opening/closing mechanism (1). In a fourth variation, the reed valve (1) constitutes the opening/closing mechanism (1).

Figure 15:
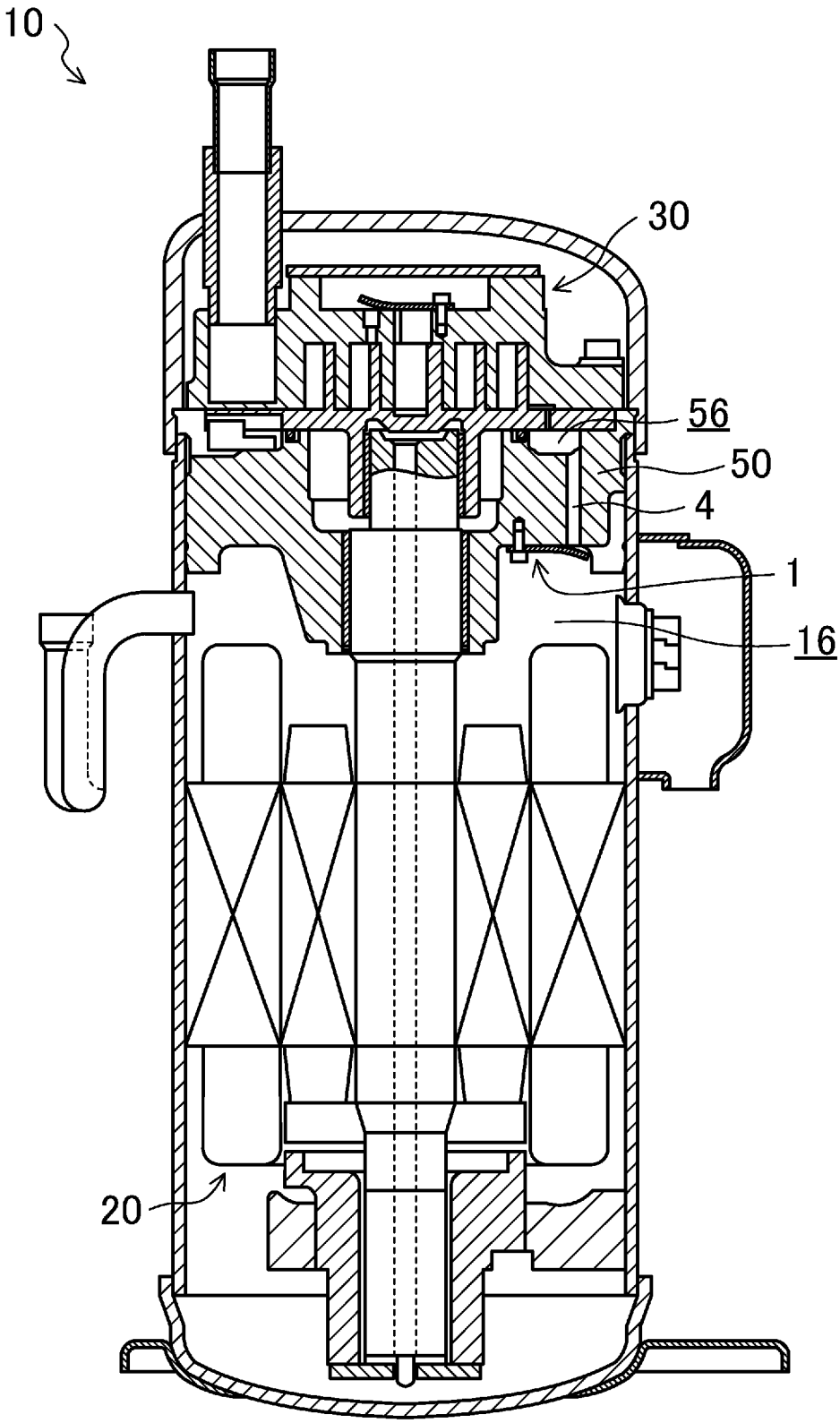
FIG. 15 is a longitudinal sectional view illustrating a scroll compressor according to a fourth variation of the embodiment.

As illustrated in FIG. 15, the bearing housing (50) has a communication passage (4) that vertically penetrates the inside of the bearing housing (50). The upper end of the communication passage (4) is open to the back pressure space (56), and the lower end of the communication passage (4) is open to the lower space (16). This communication passage (4) constitutes the fluid passage (4). The reed valve (1) is attached to the bearing housing (50) so as to open and close the opening at the lower end of the communication passage (4).

In the fourth variation, in the air conditioning system, when the pressure of the high-pressure line (71*a*) of the refrigeration circuit (70) is higher than that of the compression chamber (31) at the intermediate position, the pressure of the lower space (16) communicating with the high-pressure line (71*a*) is higher than that of the back pressure space (56) communicating with the compression chamber (31) at the intermediate position. In this case, the refrigerant is inclined to flow from the lower space (16) to the back pressure space (56) through the communication passage (4). At this time, the pressure of the refrigerant inclined to flow from the lower space (16) to the back pressure space (56) is applied onto the reed valve (1), and the reed valve (1) closes the opening at the lower end of the communication passage (4). This closing blocks a refrigerant flow from the high-pressure space (54) to the back pressure space (56).

On the other hand, in some operating states of the refrigeration circuit (70), the pressure of the high-pressure line (71*a*) of the refrigeration circuit (70) is lower than that of the compression chamber (31) at the intermediate position. When the pressure of the lower space (16) communicating with the high-pressure line (71*a*) becomes lower than that of the back pressure space (56) communicating with the compression chamber (31) at the intermediate position, the refrigerant is inclined to flow from the back pressure space (56) to the lower space (16) in the communication passage (4). At this time, the pressure of the refrigerant inclined to flow from the back pressure space (56) to the lower space (16) is applied onto the reed valve (1), thereby causing the reed valve (1) to open the opening at the lower end of the communication passage (4). Then, the refrigerant is allowed to flow from the back pressure space (56) to the lower space (16). Thus, when the pressure of the back pressure space (56) becomes higher than that of the lower space (16), the fluid passage (4) can be made open.

In the manner described above, it is possible to prevent the pressure of the back pressure space (56) from being higher than that of the high-pressure space (54), thereby reducing an excessive force of pressing the orbiting scroll (35) against the fixed scroll (40). The other parts of the configuration, operation, and advantages are the same as those in the embodiment.

—Fifth Variation of Embodiment—

Figure 16:
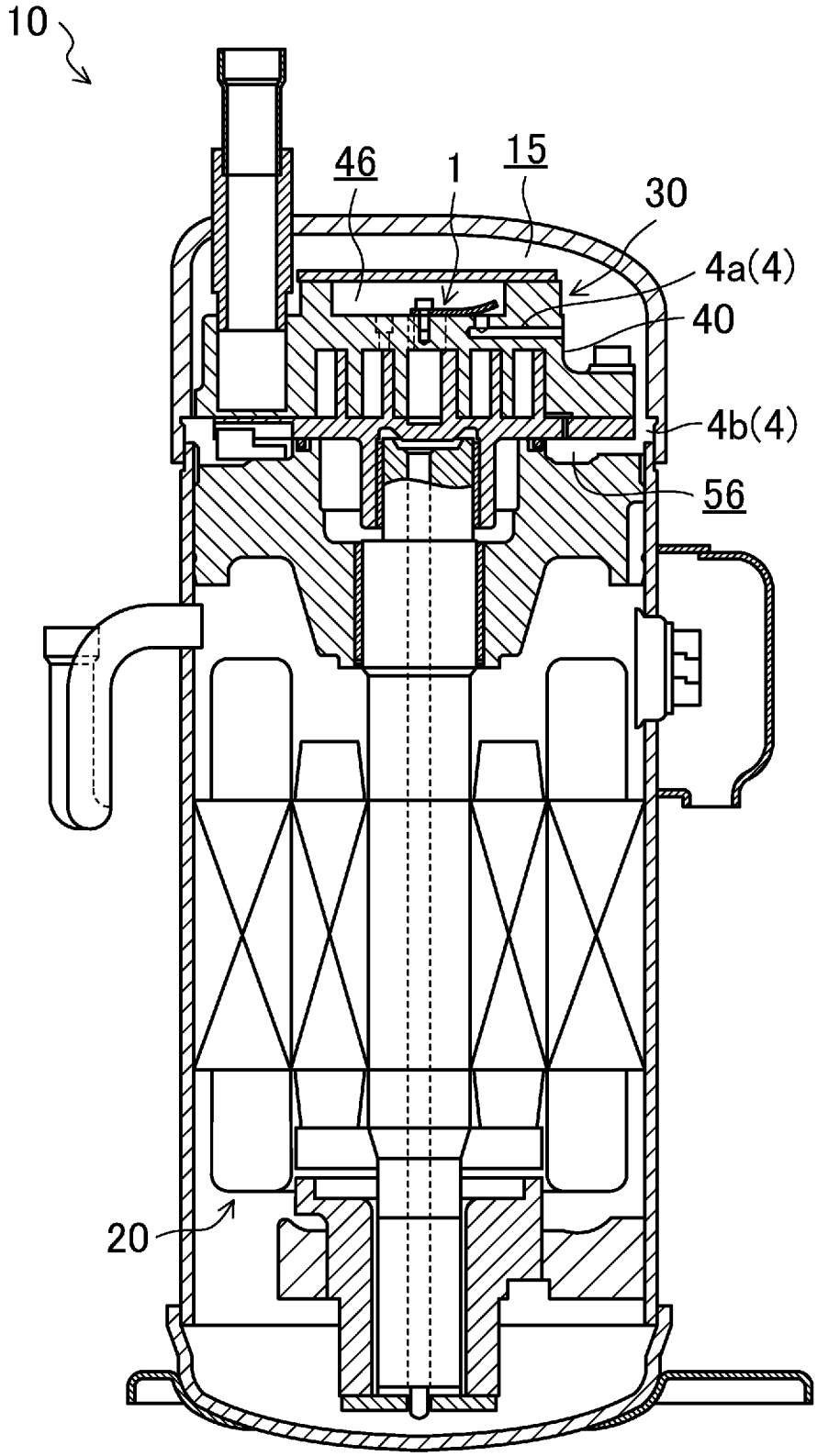
FIG. 16 is a longitudinal sectional view illustrating a scroll compressor according to a fifth variation of the embodiment.

As illustrated in FIG. 16, the fixed scroll (40) has a first communication passage (4*a*) penetrating the inner surface of the discharge chamber (46) and the outer surface of the fixed scroll (40). An end of the first communication passage (4*a*) is open to the discharge chamber (46), and the other end of the first communication passage (4*a*) is open to the upper space (15). The bearing housing (50) has a second communication passage (4*b*) allowing the inner surface of the back pressure space (56) and the upper end surface of the bearing housing (50) to communicate with each other. An end of the second communication passage (4*b*) is open to the back pressure space (56), and the other end of the second communication passage (4*b*) is open to the upper space (15). The first communication passage (4*a*) and the second communication passage (4*b*) constitute the fluid passage (4).

The reed valve (1) for opening and closing the opening of the first communication passage (4*a*) facing the discharge chamber (46) is provided in the discharge chamber (46). On the other hand, the second communication passage (4*b*) has no reed valve (1). Thus, the back pressure space (56) and the upper space (15) are always at the same pressure.

In the fifth variation, in the air conditioning system, when the pressure of the high-pressure line (71*a*) of the refrigeration circuit (70) is higher than that of the compression chamber (31) at the intermediate position, the pressure of the discharge chamber (46) communicating with the high-pressure line (71*a*) is higher than that of the upper space (15) communicating with the compression chamber (31) at the intermediate position. In this case, the refrigerant is inclined to flow from the discharge chamber (46) to the upper space (15) through the first communication passage (4*a*). At this time, the pressure of the refrigerant inclined to flow from the discharge chamber (46) to the upper space (15) is applied onto the reed valve (1), thereby closing the reed valve (1). This closing blocks a refrigerant flow from the discharge chamber (46) to the upper space (15), resulting in that the refrigerant in the discharge chamber (46) does not flow into the back pressure space (56).

On the other hand, in some operating states of the refrigeration circuit (70), the pressure of the high-pressure line (71*a*) of the refrigeration circuit (70) is lower than that of the compression chamber (31) at the intermediate position. When the pressure of the discharge chamber (46) communicating with the high-pressure line (71*a*) becomes lower than that of the back pressure space (56) communicating with the compression chamber (31) at the intermediate position, the fluid is inclined to flow from the back pressure space (56) to the upper space (15) through the second communication passage (4*b*), and then from the upper space (15) to the discharge chamber (46) through the first communication passage (4*a*). At this time, the pressure of the refrigerant inclined to flow from the upper space (15) to the discharge chamber (46) is applied onto the reed valve (1) in the first communication passage (4*a*), thereby opening the opening of the first communication passage (4*a*) facing the discharge chamber (46). Then, the fluid is allowed to flow from the upper space (15) to the discharge chamber (46), and the fluid in the back pressure space (56) flows into the discharge chamber (46).

In the manner described above, it is possible to prevent the pressure of the back pressure space (56) from being higher than that of the discharge chamber (46), thereby reducing an excessive force of pressing the orbiting scroll (35) against the fixed scroll (40). The other parts of the configuration, operation, and advantages are the same as those in the embodiment.

<<Other Embodiments>>

The embodiment may have the following configurations.

Figure 17A:
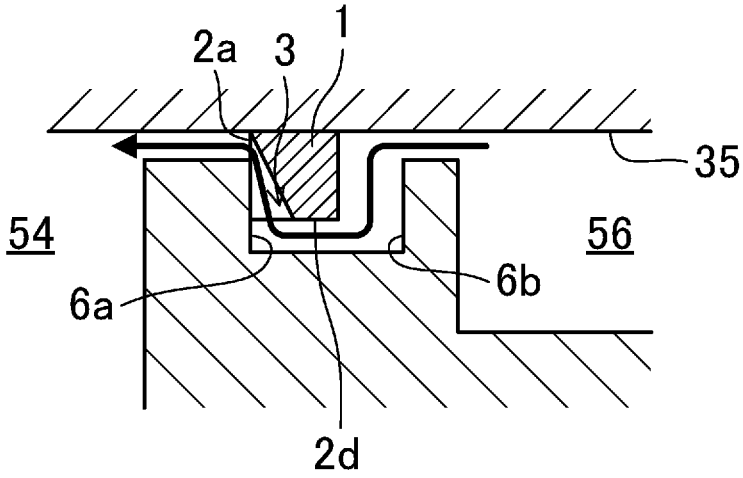
FIGS. 17A and 17B are views illustrating flows of a refrigerant in a fluid passage in another embodiment, and both illustrate flows of the refrigerant when the seal ring contracts.
Figure 17B:
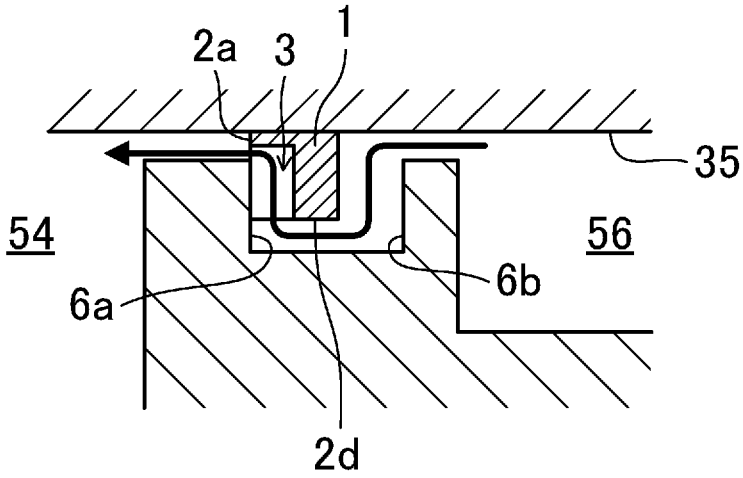

In the embodiment, the seal ring (1) is partially cut out from the upper surface (2*c*) to the lower surface (2*d*). However, the present disclosure is not limited to this shape. For example, as illustrated in FIG. 17A, the seal ring (1) may be obliquely cut out from the inner peripheral surface (2*a*) to the lower surface (2*d*). Alternatively, as illustrated in FIG. 17B, the seal ring (1) may be orthogonally cut out from the inner peripheral surface (2*a*) to the lower surface (2*d*).

The cutout position in the cutout portion (3) at the inner peripheral surface (2*a*) is located above the upper end of the inner peripheral wall (6*a*) of the ring groove (5). Then, even when the seal ring (1) contracts, the high-pressure space (54) and the back pressure space (56) can communicate with each other through the cutout portion (3). In this manner, similar advantages as those of the embodiment can be obtained.

Figure 18A:
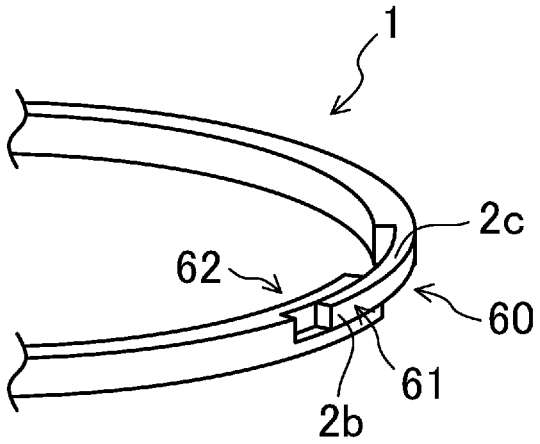
FIGS. 18A and 18B are views illustrating a seal ring according to another embodiment.
Figure 18B:
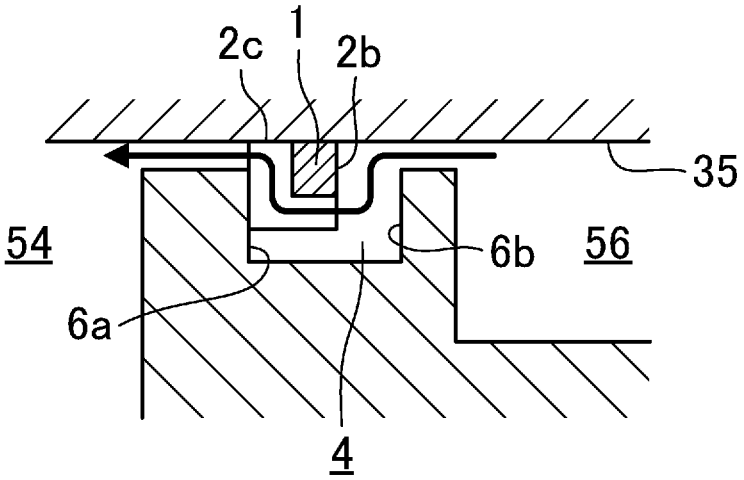

In the first variation of the embodiment, the slide surface (63) of the overlapping portion (60) of the seal ring (1) is sloped. However, the present disclosure is not limited to this shape. As illustrated in FIGS. 18A and 18B, the slide surface may have a corner at the right angle between the upper surface (2*c*) and the outer peripheral surface (2*b*). In this configuration, when the seal ring (1) contracts, the refrigerant is allowed to flow from the back pressure space (56) to the high-pressure space (54) through the clearance (3) of the seal ring (1). In this manner, similar advantages as those of the first variation can be obtained.

Figure 19A:
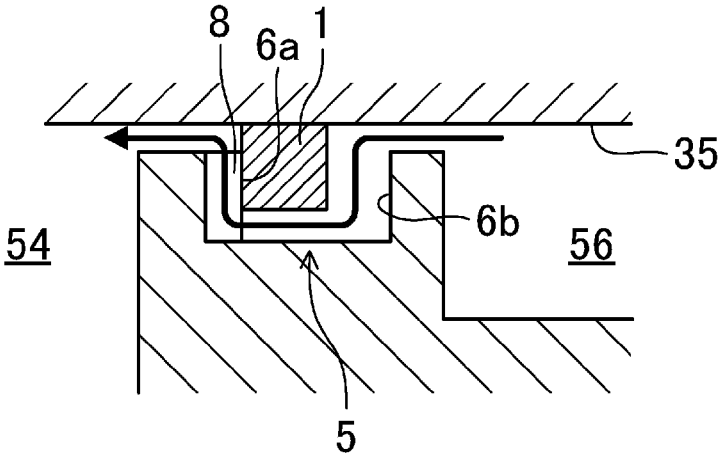
FIGS. 19A and 19B are views illustrating a seal ring according to another embodiment, FIG. 19A a view illustrating a flow of the refrigerant when the seal ring contracts.
Figure 19B:
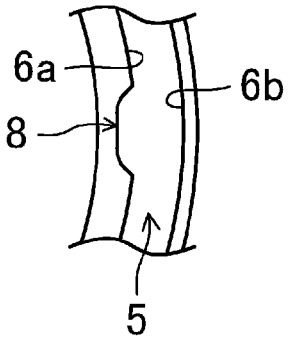
Figure 20:
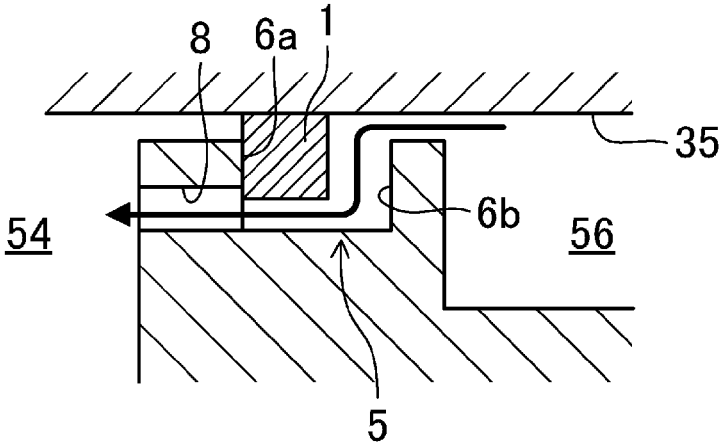
FIG. 20 is a view illustrating a flow of a refrigerant when a seal ring according to another embodiment contracts.

In the third variation of the embodiment, the inner peripheral wall (6*a*) of the ring groove (5) is cut out into a rectangular shape. However, the present disclosure is not limited to this shape. For example, as illustrated in FIGS. 19A and 19B, the inner peripheral wall (6*a*) may be recessed from the upper end to form a dent (8). Alternatively, as illustrated in FIG. 20, a penetration hole (8) may be formed through the inner peripheral wall (6*a*). In this manner, even in the configurations in which the inner peripheral wall (6*a*) has the dent (8) or the penetration hole (8), when the seal ring (1) contracts, the refrigerant is allowed to flow from the back pressure space (56) to the high-pressure space (54) through the dent (8) or the penetration hole (8). Thus, similar advantages as those of the third variation can be obtained.

In the embodiment, the seal ring (1), for example, constitutes the opening/closing mechanism. Alternatively, the opening/closing mechanism may have other configurations. For example, the opening/closing mechanism may include a communication passage allowing the high-pressure space (54) and the back pressure space (56) to communicate with each other, a shut-off valve provided in the communication passage, and a controller for the shut-off valve. In this case, a pressure sensor detects the pressures of the high-pressure space (54) and the back pressure space (56). Based on a signal from the pressure sensor, when the pressure of the back pressure space (56) is lower than that of the high-pressure space (54), the controller closes the shut-off valve, and when the pressure of the back pressure space (56) is higher than that of the high-pressure space (54), the controller opens the shut-off valve.

INDUSTRIAL APPLICABILITY

As described above, the present disclosure is useful for a scroll compressor capable of pressing an orbiting scroll against a fixed scroll by introducing a fluid that is being compressed into a back pressure space facing the back surface of the orbiting scroll.

DESCRIPTION OF REFERENCE CHARACTERS

1 seal ring (opening/closing mechanism)
3 cutout portion (communication part)
4 fluid passage
5 ring groove
10 scroll compressor
11 casing
12 body
15 upper space
16 lower space
20 motor
23 driving shaft
27 oil supply passage
28 lower bearing part

30 compression mechanism (rotary compression mechanism)
31 compression chamber
32 discharge port
33 intermediate port
34 suction port
35 orbiting scroll
40 fixed scroll
43 outer edge
46 discharge chamber
50 bearing housing (forming member)
52 hollow portion
53 bearing part
54 high-pressure space
56 back pressure space
60 overlapping portion
70 refrigeration circuit

The invention claimed is:

1. A scroll compressor, comprising:

a casing;

a rotary compression mechanism housed in the casing, and including a compression chamber formed by engaging a fixed scroll and an orbiting scroll with each other;

a discharge port located in the compression mechanism and being open at a discharge position of the compression chamber;

an intermediate port located in the compression mechanism and being open at an intermediate position of the compression chamber;

a forming member located in the casing and including a back pressure space and at least part of a fluid passage, the back pressure space facing a back surface of the orbiting scroll and communicating with the intermediate port, the fluid passage allowing a high-pressure space communicating with the discharge port and the back pressure space to communicate with each other; and an opening/closing mechanism configured to close the fluid passage when a pressure of the back pressure space is lower than that of the high-pressure space, and open the fluid passage when the pressure of the back pressure space is higher than that of the high-pressure space, wherein the opening/closing mechanism is held by a ring groove that is open to the fluid passage of the forming member, the opening/closing mechanism is configured to freely expand and contract between an inner peripheral wall and an outer peripheral wall of the ring groove, the opening/closing mechanism is constituted by a seal ring including: an outer peripheral sealing surface that seals a gap between the back pressure space and the fluid passage when the seal ring is at an expanded position at which the seal ring is in contact with the outer peripheral wall; and an inner peripheral sealing surface that seals a gap between the high-pressure space and the fluid passage when the seal ring is at a contracted position at which the seal ring is in contact with the inner peripheral wall, and a communication part allowing the high-pressure space and the fluid passage whose gap is sealed by the inner peripheral sealing surface to communicate with each other is provided in a surface of the seal ring at the contracted position that is in contact with the inner peripheral wall.

2. The scroll compressor of claim 1, wherein the seal ring is interrupted at a position along a circumference thereof to have a first end and a second end, and has an overlapping portion in which side surfaces of the first end and the second end slidably overlap each other along the circumference, the first end of the seal ring has a counter surface facing an end surface of the second end of the seal ring along the circumference, and the communication part of the seal ring is a clearance located between the counter surface of the first end and the end surface of the second end when the seal ring is at the contracted position.

3. A scroll compressor, comprising:

a casing;

a rotary compression mechanism housed in the casing, and including a compression chamber formed by engaging a fixed scroll and an orbiting scroll with each other;

a discharge port located in compression mechanism and being open at a discharge position of the compression chamber;

an intermediate port located in the compression mechanism and being open at an intermediate position of the compression chamber;

a forming member located in the casing including a back pressure space and at least part of a fluid passage, the back pressure space facing a back surface of the orbiting scroll and communicating with the intermediate port, the fluid passage allowing a high-pressure space communicating with the discharge port and the back pressure to communicate with each other; and an opening/closing mechanism configured to close the fluid passage when a pressure of the back pressure space is lower that that of the high-pressure space, and open the fluid passage when the pressure of the back pressure space is higher that that of the high-pressure space, wherein the opening/closing mechanism is held by a ring groove that is open to the fluid passage of the forming member, and the opening/closing mechanism is constituted by a seal ring configured to freely expand and contract between an expanded position at which the seal ring is in contact with an outer peripheral wall of the ring groove to seal a gap between the back pressure space and the fluid passage and a contracted position at which the seal ring is separated from both of an inner peripheral wall and the outer peripheral wall of the ring groove to open the fluid passage.

4. A scroll compressor, comprising:

a casing a rotary compression mechanism housed in the casing, and including a compression chamber formed by engaging a fixed scroll and an orbiting scroll with each other;

a discharge port located in the compression mechanism and being open at a discharge position of the compression chamber;

an intermediate port located in the compression mechanism and being open at an intermediate position of the compression chamber;

a forming member located in the casing and including a back pressure space and at least part of a fluid passage, the back pressure space facing a back surface of the orbiting scroll and communicating with intermediate port, the fluid passage allowing a high-pressure space communicating with the discharge port and the back pressure space to communicate with each other; and an opening/closing mechanism configured to close the fluid passage when a pressure of the back pressure space is lower than that of the high-pressure space, and open the fluid passage when the pressure of the back pressure space is higher than that of the high-pressure space, wherein the opening/closing mechanism is held by a ring groove that is open to the fluid passage of the forming member, the opening/closing mechanism is constituted by a seal ring configured to freely expand and contract between an inner peripheral wall and an outer peripheral wall of the ring groove, seal a gap between the back pressure space and the fluid passage at an expanded position at which the seal ring is in contact with the outer peripheral wall, and seal a gap between the high-pressure space and the fluid passage at a contracted position at which the seal ring is in contact with the inner peripheral wall, the inner peripheral wall of the ring groove has a contact portion with which the seal ring at the contracted position is in contact, and a communication part allowing the high-pressure space and the fluid passage whose gap is sealed by the seal ring to communicate with each other is provided in the contact portion of the inner peripheral wall.

* * * * *